US008783180B1

(12) United States Patent
Donato et al.

(10) Patent No.: US 8,783,180 B1
(45) Date of Patent: Jul. 22, 2014

(54) PORTABLE MANUALLY OPERABLE PRINTING PROOFER

(75) Inventors: Anthony Gene Donato, Fort Mill, SC (US); Timothy Darren Livingston, Corryton, TN (US)

(73) Assignee: Harper Corporation of America, Charlotte, NC (US)

( * ) Notice: Subject to any disclaimer, the term of this patent is extended or adjusted under 35 U.S.C. 154(b) by 862 days.

(21) Appl. No.: 12/799,237

(22) Filed: Apr. 21, 2010

(51) Int. Cl.
*B41F 3/28* (2006.01)
*B41F 5/20* (2006.01)
*B41F 5/24* (2006.01)

(52) U.S. Cl.
USPC ..... 101/479; 101/327; 101/328; 101/329; 101/216

(58) Field of Classification Search
CPC ..... B41F 3/28; B41F 5/20; B41F 15/426; B41P 2217/10
USPC ..... 101/216, 218, 329, 328, 327, 479
See application file for complete search history.

(56) References Cited

U.S. PATENT DOCUMENTS

| | | | | |
|---|---|---|---|---|
| 2,991,713 | A * | 7/1961 | McFarland | 101/348 |
| 3,018,725 | A | 1/1962 | Maul et al. | |
| 3,098,435 | A * | 7/1963 | Flower et al. | 101/212 |
| 3,633,505 | A | 1/1972 | Ferrari | |
| 4,024,813 | A | 5/1977 | Thiene et al. | |
| 4,024,816 | A | 5/1977 | Williams et al. | |
| 4,522,057 | A | 6/1985 | Kerchiss | |
| 4,852,486 | A | 8/1989 | Ely et al. | |
| 4,984,532 | A | 1/1991 | Winters | |
| 5,495,800 | A | 3/1996 | Weissbein et al. | |
| 6,033,477 | A * | 3/2000 | Ueberschar | 118/413 |
| 6,378,426 | B1 | 4/2002 | Furr, Jr. | |
| 6,814,001 | B2 | 11/2004 | Westby et al. | |
| 7,275,482 | B2 * | 10/2007 | Westby | 101/218 |
| 7,281,473 | B2 | 10/2007 | Westby et al. | |
| 7,316,182 | B2 | 1/2008 | Westby | |
| 7,574,956 | B2 | 8/2009 | Westby | |
| 2006/0260491 | A1 | 11/2006 | Westby | |
| 2007/0006750 | A1 | 1/2007 | Westby | |
| 2008/0264286 | A1 | 10/2008 | Westby | |

* cited by examiner

*Primary Examiner* — Ren Yan
*Assistant Examiner* — Justin Olamit
(74) *Attorney, Agent, or Firm* — Nelson Mullins Riley & Scarborough LLP

(57) ABSTRACT

A manually operable proofing apparatus for performing sample test printings comprises a table for supporting a printable substrate, a carriage supported on the table for reciprocal movement along the printing surface, and a proofer assembly comprising an anilox roller for applying a printing material to the substrate. The carriage and the proofer assembly have matable quick-connect elements for selective attachment and detachment of the proofer assembly to, and from the carriage without fasteners or tools. The quick-connect element of the proofer assembly comprises a pair of bearings, and the quick-connect element of the carriage comprises a bracket defining an open receiving area for mated receipt of the bearing elements of the proofer assembly. The bracket of the carriage has a detent for retaining the bearing elements in an operational disposition supporting the anilox roller adjacent the printing surface when the bearing elements are mated within the receiving area.

19 Claims, 9 Drawing Sheets

PORTABLE MANUALLY OPERABLE PRINTING PROOFER

FIELD OF THE INVENTION

The present invention relates generally to commercial printing operations, especially such operations utilizing engraved anilox printing rolls. More particularly, the present invention relates to devices commonly referred to in the industry as "proofers" used for producing sample test printings of inks, coatings and the like preparatory to the implementation of a commercial printing operation, e.g., for determining appropriate printing roll characteristics and parameters for color selection or color matching purposes.

BACKGROUND OF THE INVENTION

In conventional flexographic printing operations, it is widely recognized that the consistent delivery of a uniformly thin film of ink to the printing plate is critical to achieving consistent satisfactory print quality and, toward that end, the physical characteristics of the anilox roll largely determine the thinness and uniformity of the ink film transferred to the printing plate. Generally speaking, so long as a minimum acceptable density of ink is consistently maintained, it is desirable that the ink film delivered by the anilox roll be as thin as possible in order to provide optimal contrast and print fidelity.

As is known, anilox rolls are engraved, typically either by a mechanical or a laser engraving operation, to produce an array of recesses circumferentially about the peripheral surface of the roll, commonly referred to as "cells." Somewhat overly simplified, the principal characteristics of anilox rolls which determine the thickness or thinness of the ink film are the size, shape and depth of each cell, which determine the volume of ink each cell can contain, and the relative arrangement and spacing of the cells over the peripheral roll surface, generally measured and expressed as the number of cells per linear inch of the roll surface and commonly referred to as the "line screen" of a given roll. The engraved volume of the cells of an anilox roll is one of the important factors affecting the color characteristics that will be achieved with a given ink.

In view of these variables in anilox rolls which affect the results in general and the quality in particular of a printing operation, the selection of the appropriate combination of physical characteristics for an anilox roll to accomplish a given printing operation is not necessarily capable of being precisely predicted and, hence, is currently as much an art as a science in actual practice. It is accordingly commonplace to perform test printings with differing anilox rolls preparatory to setting up and implementing a commercial printing operation in order to determine and verify the optimal necessary and desirable roll characteristics, e.g., cell size and shape and line screen, particularly for color testing and matching purposes.

Because of the large size of flexographic printing presses and the anilox rolls used therein, it is difficult, expensive and impractical to perform multiple test runs at the full scale of commercial equipment. Hence, miniature devices commonly referred to as "proofers" have been developed to enable more simplified print testing runs to be performed. While these conventional proofing devices are generally satisfactory in operation at least from the standpoint that the results of such proofers are typically more accurate and reliable than the selection of anilox rolls without preliminary "proofing" tests, the known conventional proofers still suffer various drawbacks and disadvantages. Generally, proofers are of two basic types: proofers adapted for manual operation and proofers that are automated. Manual proofers offer the advantage of portability and operability without access to a utility source, but the results of manual proofing can vary widely according to differences in operator skill, experience and technique, and can even vary in results by the same operator. Automated proofers can offer the advantage of more consistent results, by eliminating operator-induced variations, but are disadvantageous in being more bulky, less portable and requiring access to a utility source for operating power. Thus, there exists a substantial need within the relevant industry for a portable manual proofer which can be operated with precision by different users with consistent results.

SUMMARY OF THE INVENTION

It is accordingly an objection of the present invention to provide an improved portable manual proofer assembly and a portable manual proofing apparatus utilizing the proofer assembly, which address the above-described deficiencies of known conventional proofers.

Briefly summarized, the present invention addresses this objective by providing a manually operable proofer basically comprising a table defining a printing surface for supporting a printable substrate for receiving a test printing, a carriage supported on the table for reciprocal movement in a defined path adjacently along the printing surface, and a proofer assembly comprising an anilox roller for applying a printing material.

According to one feature of the present invention, the carriage and the proofer assembly have respectively matable quick-connect elements for selective attachment and detachment of the proofer assembly to and from the carriage into and out of an operative printing disposition without fasteners or tools. More specifically, the quick-connect element of the proofer assembly comprises a pair of bearing elements, and the quick-connect element of the carriage comprises a bracket element defining an open receiving area configured for mated receipt of the bearing elements of the proofer assembly. The bracket element of the carriage comprises a detent element bordering the receiving area for deflection thereof during passage of the bearing elements into and out of the receiving area and for retaining the bearing elements in an operational disposition supporting the anilox roller adjacent the printing surface when the bearing elements are mated within the receiving area.

In a preferred embodiment, the clamping arm of the carriage may comprise a first abutment surface within the receiving area for engagement with a first bearing element of the proofer assembly and a second abutment surface within the receiving area for engagement with a second bearing element of the proofer assembly. The proofer assembly may further comprise a transfer roller in axially-parallel peripheral surface abutment with the anilox roller and a doctor blade supported in tangential relation to the anilox roller. The transfer roller is supported in surface contact with a printable substrate on the printing surface when in the operational disposition defined by the clamping arm.

In accordance with another aspect of the present invention, the proofer assembly comprises a positioning element for the doctor blade, and the doctor blade and the positioning element comprise respectively attractive magnetic elements for urging the doctor blade into an operational position relative to the anilox roller.

According to another feature of the present invention, the proofer assembly comprises a frame element defining a receiving slot for selective attachment and detachment of the anilox roller to and from the frame element without fasteners or tools. More specifically, the receiving slot may be oriented relative to the transfer roller for deflection thereof upon insertion and removal of the anilox roller into and out of the slot and for retaining the anilox roller against unintended removal from the slot when fully received within the slot. The anilox roller may comprise a pair of bushings at opposite axial ends of the anilox roller, and the frame element of the proofer may comprise a pair of spaced-apart slot portions for receiving the bushings. The bushings are preferably detachable from the anilox roller for use with differing anilox rollers, thereby to facilitate interchanging of the anilox roller with another anilox roller.

The proofer assembly may include a handle for manual actuation of movement of the carriage and the proofer assembly as a unit when the proofer assembly is mated to the carriage.

Alternatively, the carriage may further comprise a weighted element attached to the carriage via a pulley arrangement for actuation of movement of the carriage and the proofer assembly as a unit when the proofer assembly is mated to the carriage via gravitational action on the weighted element.

The table may comprise a support for a roll of substrate material in disposition to feed the substrate onto the printing surface. The table may further comprise a clamping roller movable between an operative clamping position at the printing surface for holding the substrate thereagainst and an inoperative parked position spaced above the printing surface for permitting feeding of the substrate from the roll of substrate material.

Other characteristics, features and advantages of the proofer of the present invention will be described and understood from the following disclosure of a preferred embodiment of the proofer with reference to the accompanying drawings.

DETAILED DESCRIPTION OF THE PREFERRED EMBODIMENT

Figure 1:
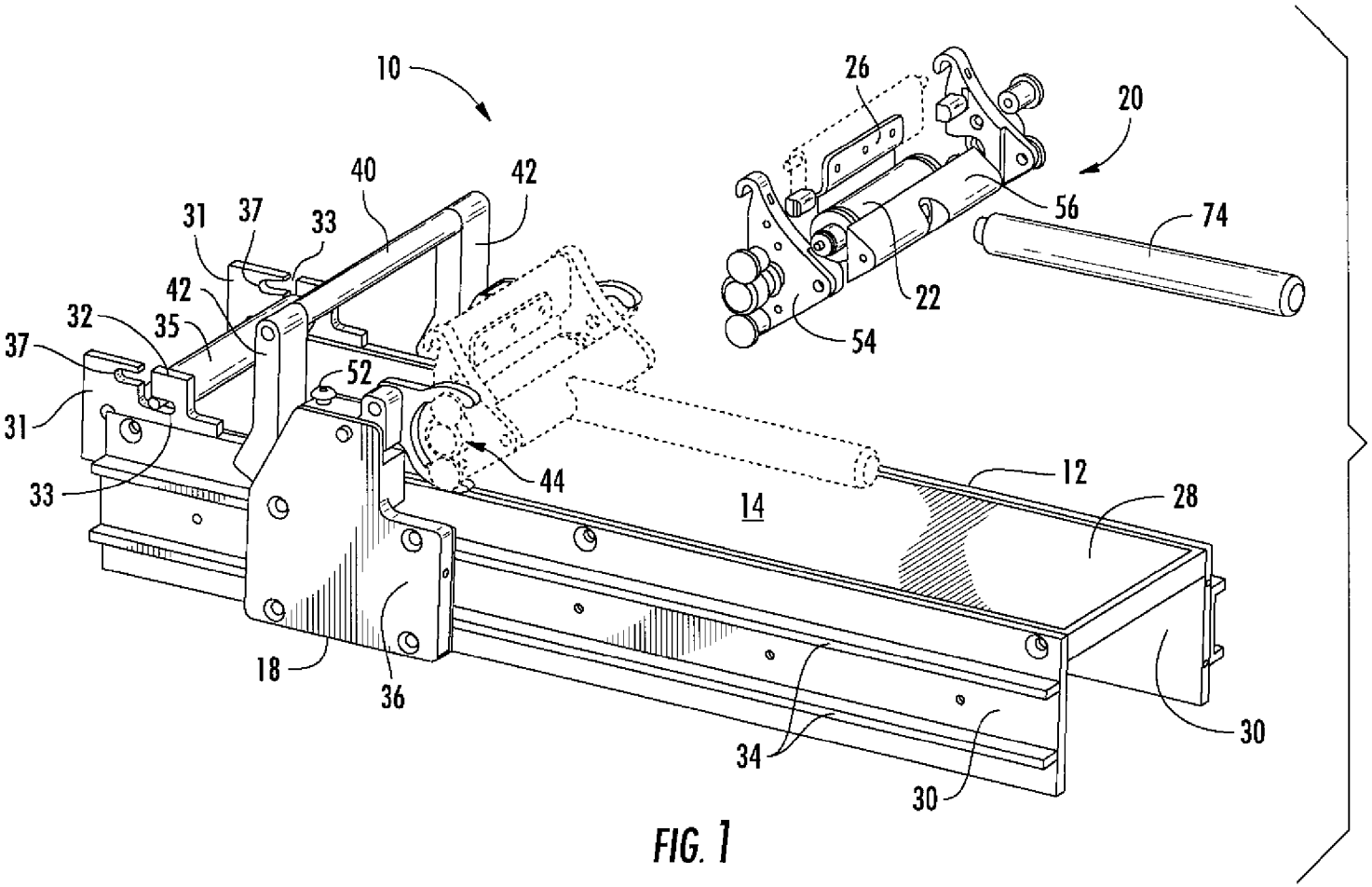
FIG. 1 is a perspective view of a proofer apparatus in accordance with one preferred embodiment of the present invention.

Referring now to the accompanying drawings and initially to FIG. 1, one preferred embodiment of the proofer apparatus of the present invention is indicated in its totality by the reference numeral 10, shown in fully assembled form with its proofer assembly in broken lines in its operational position and in full solid lines shown in exploded relation, to promote clarity of illustration. As more fully explained hereinafter, the proofer apparatus 10 is adapted for manual operation to produce sample test printings, whether of printing inks or other coatings typically applied in a commercial printing operation. While the present invention is described herein in connection with this preferred construction of the proofer apparatus 10, it is to be understood and will be readily recognized by persons skilled in the relevant art that the proofer apparatus 10 is susceptible of a broad utility and varied applications, and may be susceptible to differing modifications, adaptations, improvements and other changes, all of which are considered to be within the overall scope of the present invention. Hence, the present invention is not to be interpreted as being limited or specific to the particular preferred construction herein described.

As shown in FIG. 1, the proofer apparatus 10 basically comprises a table 12 which defines a printing surface 14 for supporting a printable substrate, such as printing paper (not shown), a carriage 18 supported on the table 12 for reciprocal movement in a defined path adjacently along the printing surface 14, and a proofer assembly 20 comprising an anilox roller 22, a transfer roller 24, and a doctor blade 26, selectively mountable and demountable as a unit to and from the carriage, for cooperatively applying a printing material, such as an ink or another coating material, to the substrate.

The table 12 may be of any construction and configuration suitable for supporting the substrate during proof printing operations. In the illustrated embodiment, by way of example, the table 12 comprises a deck 28 of an elongated rectangular configuration supported horizontally by two spaced-apart upstanding side members 30 affixed to and extending in parallel relation along the opposite lateral side edges of the deck 28. The upper surface of the deck 28 is substantially planar to form the printing surface 14 as a flat support for the printing paper or like substrate. A pair of guide rails 34, for example, in the form of open channel members or other suitable guide members, are affixed respectively to the laterally outwardly facing side surfaces of the side members 30 and extend longitudinally along substantially the full length thereof, for supporting the carriage 18 for movement along the table 12.

A clamp device 32 is mounted adjacent the upper surface of the deck 28 at one end thereof to provide a means of holding the substrate securely in overlying relation to the surface 14 during proof printing operations. The clamp device 32 comprises an upwardly projecting bracket portion 31 of each side member 30 adjacent opposite sides of the deck 28 in each of which is formed a slot 33 to position a clamping roller 35 in surface contact with the printing surface 14 to hold the paper or other printing substrate stationary on the printing surface 14. Each slot 33 includes a lateral notch 37 adjacent the upper end of the slot in which the clamping roller 35 may be supported at an elevated spacing above the printing surface 14 when paper in being placed onto the printing surface 14 preparatory to a printing proof or is be removed from the surface 14 after performing a printing proof.

Figure 3:
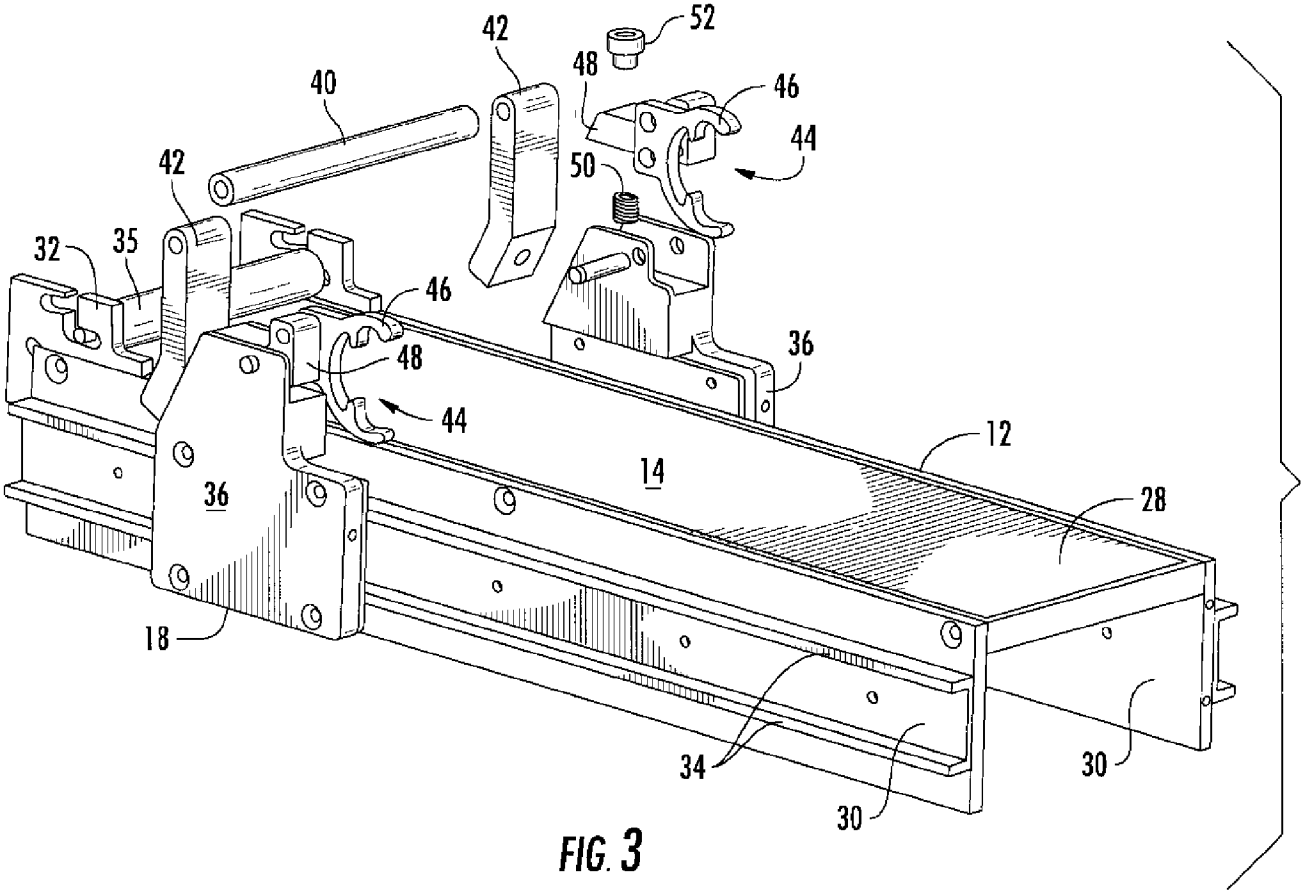
FIG. 3 is an exploded perspective view of the table and carriage assembly of the proofer apparatus of FIG. 1.

As best seen in FIG. 3, the carriage 18 comprises a pair of upright lateral frame assemblies 36 disposed in spaced-apart facing parallel relation to one another and in outwardly overlying relation to the respective side members 30 of the table 12, and joined integrally together by a handle 40 extending transversely between upright bracket portions 42 on each frame assembly 36. Each frame assembly 36 carries on its inwardly facing side a ball-bearing guide assembly (not shown) which is received within the respective guide rail 34 of the adjacent table side member 30 for gliding movement of the lateral frame assemblies 36 and the handle 40 as a unit along the table 12 under the guidance and constraint of the guide rails 34.

The carriage 18 further comprises a bracket assembly, indicated overall at 44, for mounting and demounting of the proofer assembly 20 to and from the carriage 18. More specifically, the bracket assembly 44 comprises a pair of C-shaped bracket elements 46 pivotably supported in spaced-apart facing parallel relation by a respective pair of rocker arms 48 mounted pivotably to the lateral frame members 36. The rocker arms 48 are biased into a normal equilibrium position by springs 50 acting between the arms 48 and the lateral frame members 36. Optionally, a pair of loading knobs 52 may be provided for selectively adjusting the tensioning of the springs 50. As best seen in FIGS. 5-8, each C-shaped bracket element 46 defines an open receiving area 46A interiorly within the bracket element 46. An upper arcuate abutment surface 46B is formed within one side of the receiving area 46A between the upper outer edge of the bracket element 46 and an interior shoulder 46C and an opposing lower arcuate abutment surface 46D is formed within the opposite side of the receiving area 46A between the lower outer edge of the bracket element 46 and a second interior shoulder 46E. A spring-loaded detent element 53 is mounted to the lower outer edge of the bracket element 46 outwardly adjacent the abutment surface 46D.

Figure 2:
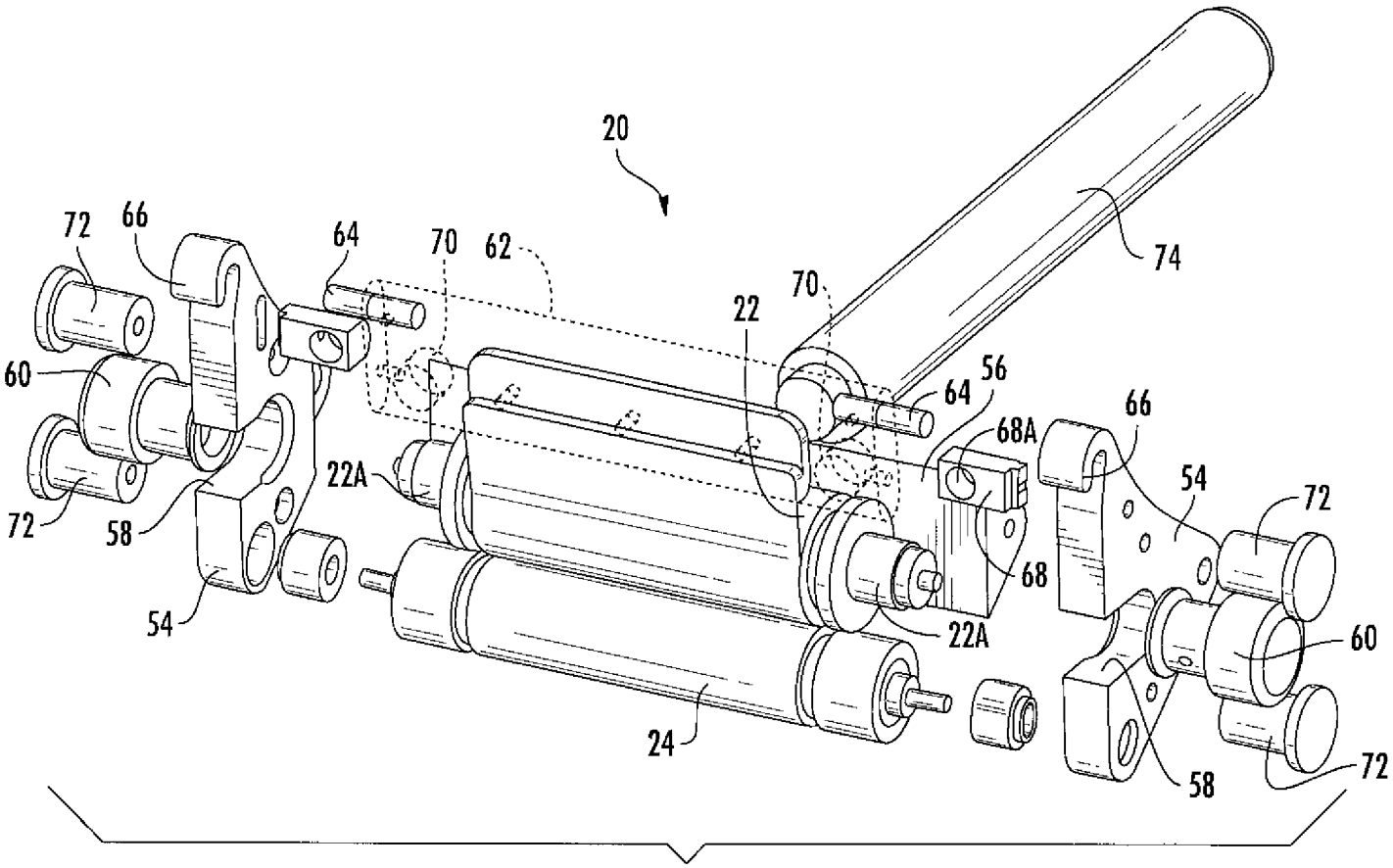
FIG. 2 is an exploded perspective view of the proofer assembly of the proofer apparatus of FIG. 1.
Figure 4:
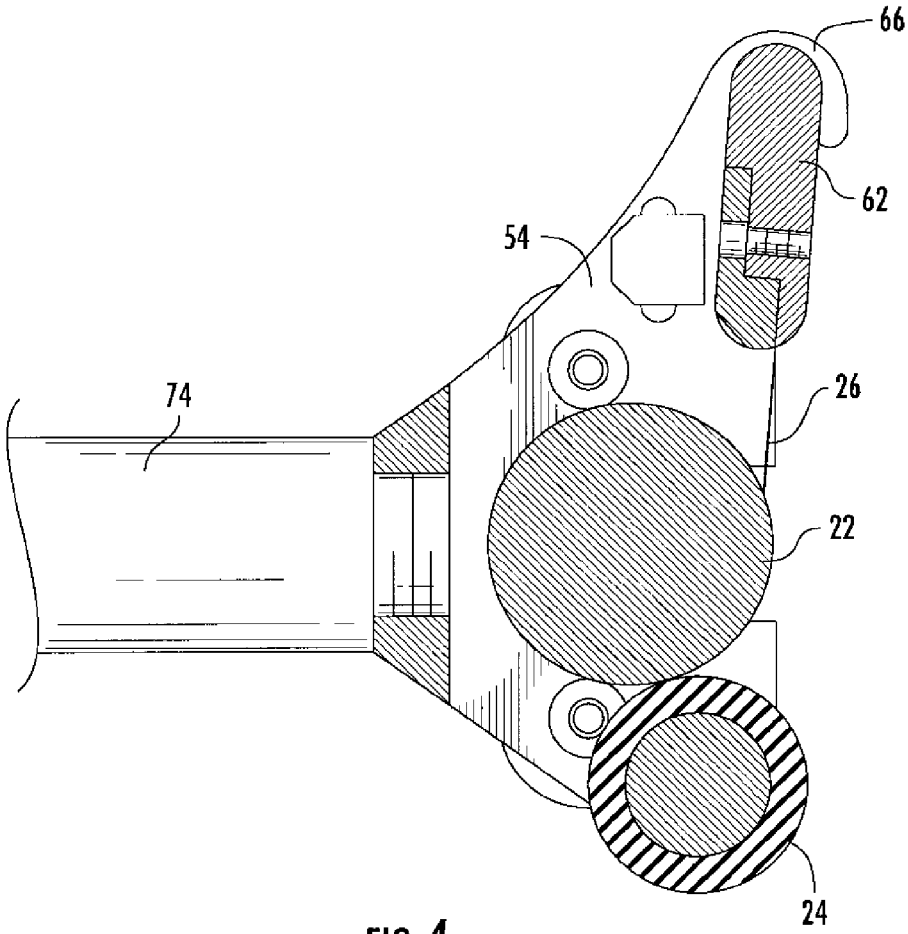
FIG. 4 is a vertical cross-sectional view of the proofer assembly of FIGS. 1 and 2, in assembled form and taken along line 4-4 of FIG. 2.
Figure 5:
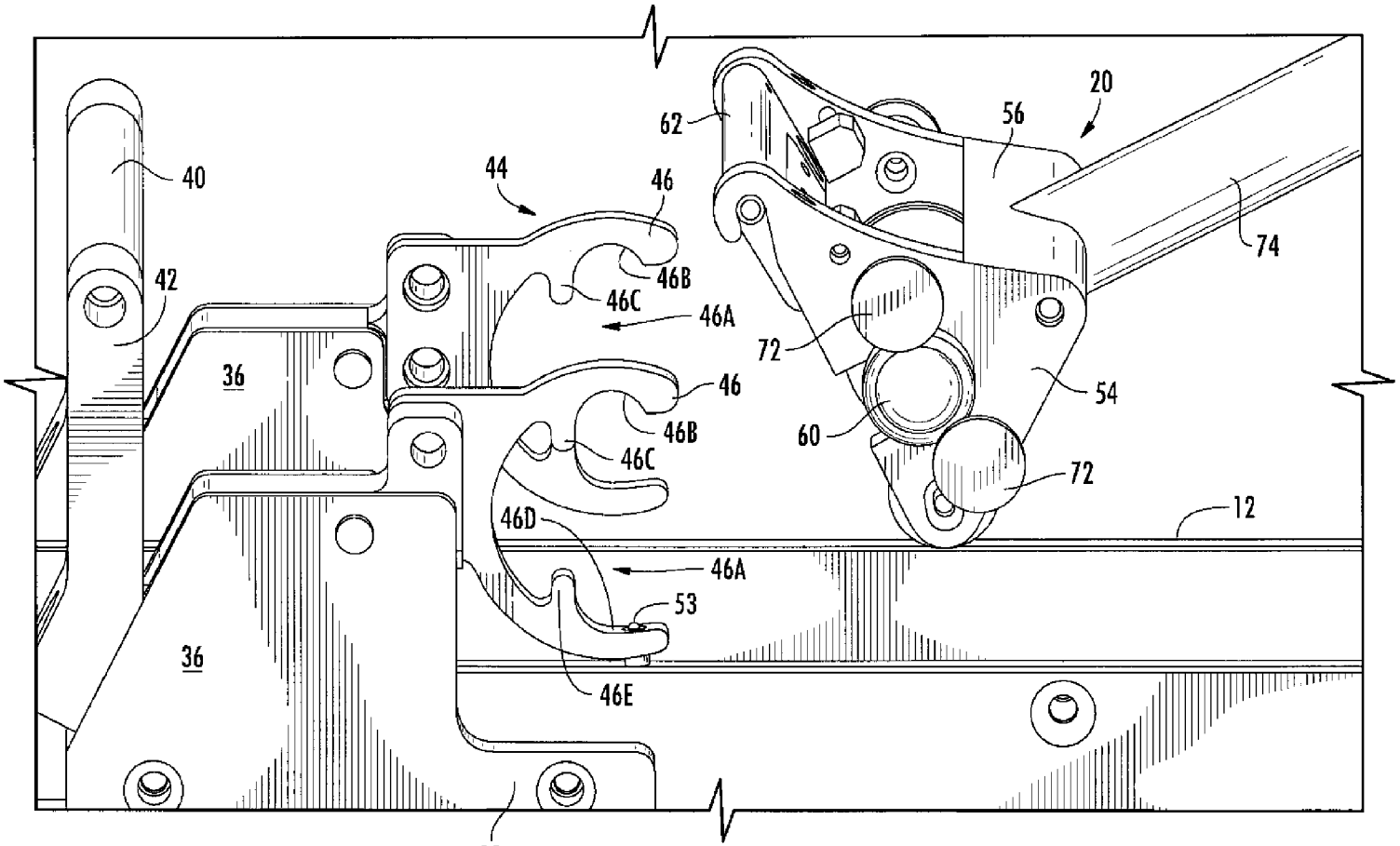
FIGS. 5 through 8 are fragmentary side elevational views of the proofer apparatus of FIG. 1, illustrating in sequence the attachment of the proofer assembly to the table and carriage assembly.

As seen in FIG. 2, the proofer assembly 20 comprises a pair of end frame elements 54 connected together in spaced parallel facing relation by a transverse frame element 56. The transfer roller 24 is rotatably supported between the end frame elements 54 in a fixed position at the lower side of the proofer assembly 20. A receiving slot for the anilox roller 22 is defined in the proofer assembly 20 by a pair of aligned open-ended slot portions 58 formed respectively in the opposing end frame elements 54 immediately above the location of the transfer roller 20. A pair of spring-loaded bushings 60 are detachably mountable to stub shafts 22A protruding outwardly from the opposite ends of the anilox roller 22, and are of a diametric size to fit snugly in the slot portions 58 to facilitate selective mounting and demounting of the anilox roller 22, and exchange for a replacement or alternative anilox roller 22, to and from the end frame elements 54. The slot portions 58 are oriented relative to the transfer roller 20 to cause the periphery of the anilox roller 22 to contact the periphery of the transfer roller 20 and to require a slight deflection of the transfer roller 20 to enable the bushings 60 of the anilox roller 22 to pass fully into and to seat within the slot portions 58, as depicted in FIG. 4. In this manner, the anilox roller 22 is securely retained within the slot portions 58 once the bushings 60 are fully seated, yet still permitting the anilox roller 22 to be readily inserted and removed into and from the slot portions 58.

The doctor blade 26 is affixed to a support bar 62 from which mounting pins 64 extend outwardly at the opposite ends of the support bar 62. A hook-shaped mounting seat 66 is formed in the upper side of each end frame element 54 to receive the mounting pins 64 to form a positioning seat for the doctor blade 26. A pair of positioning target blocks 68 for the doctor blade 26 are affixed to, and extend toward one another from, the respective inwardly facing surfaces of the end frame elements 54. Each target block 68 carries a magnet 68A and a pair of mating magnets 70 are mounted to the support bar 62 to attract one another when the pins 64 are seated in the mounting seats 66 to urge the doctor blade 26 into tangential peripheral contact to the anilox roller 22 with a defined degree of contact force. A pair of capstans 72 are affixed at upper and lower positions projecting from the outward side surfaces of each of the end frame elements 54 as positioning elements to engage within the abutment surfaces of the C-shaped bracket elements 46 of the carriage 18, as will be more fully described presently. A handle element 74 projects from the center of the transverse connecting bar 56 for manual handling and operation of the proofer assembly 20.

Figure 6:
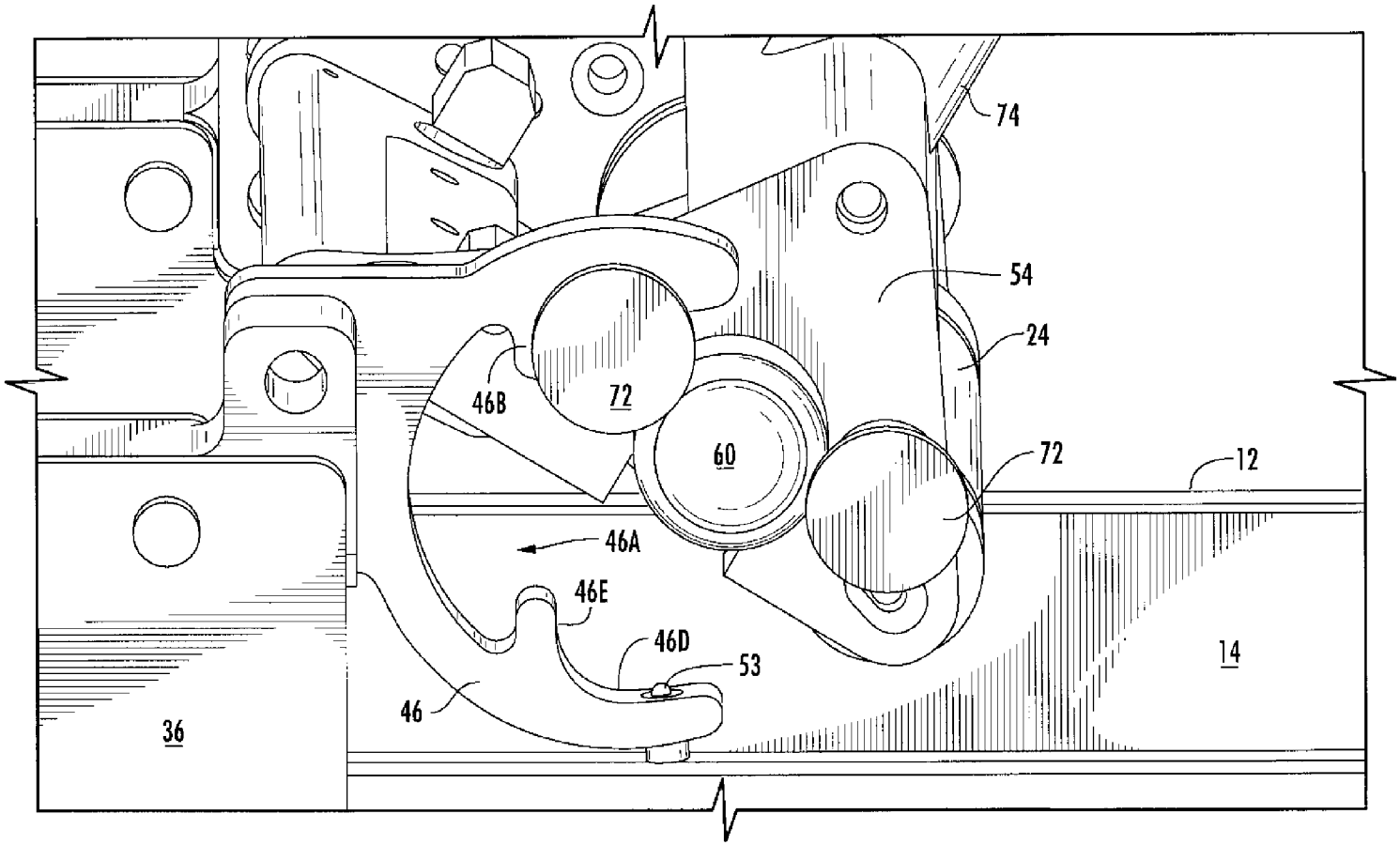
Figure 7:
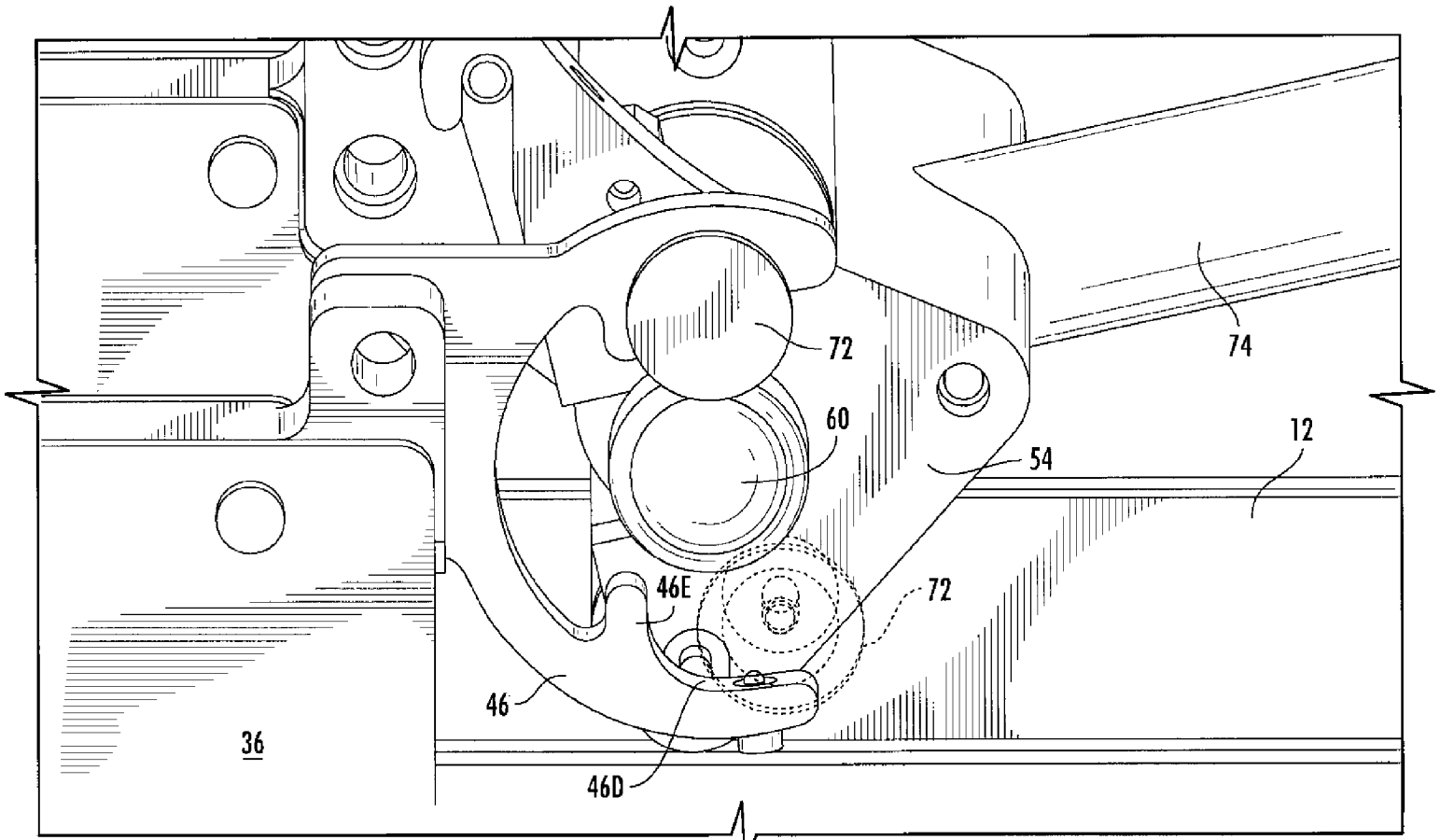
Figure 8:
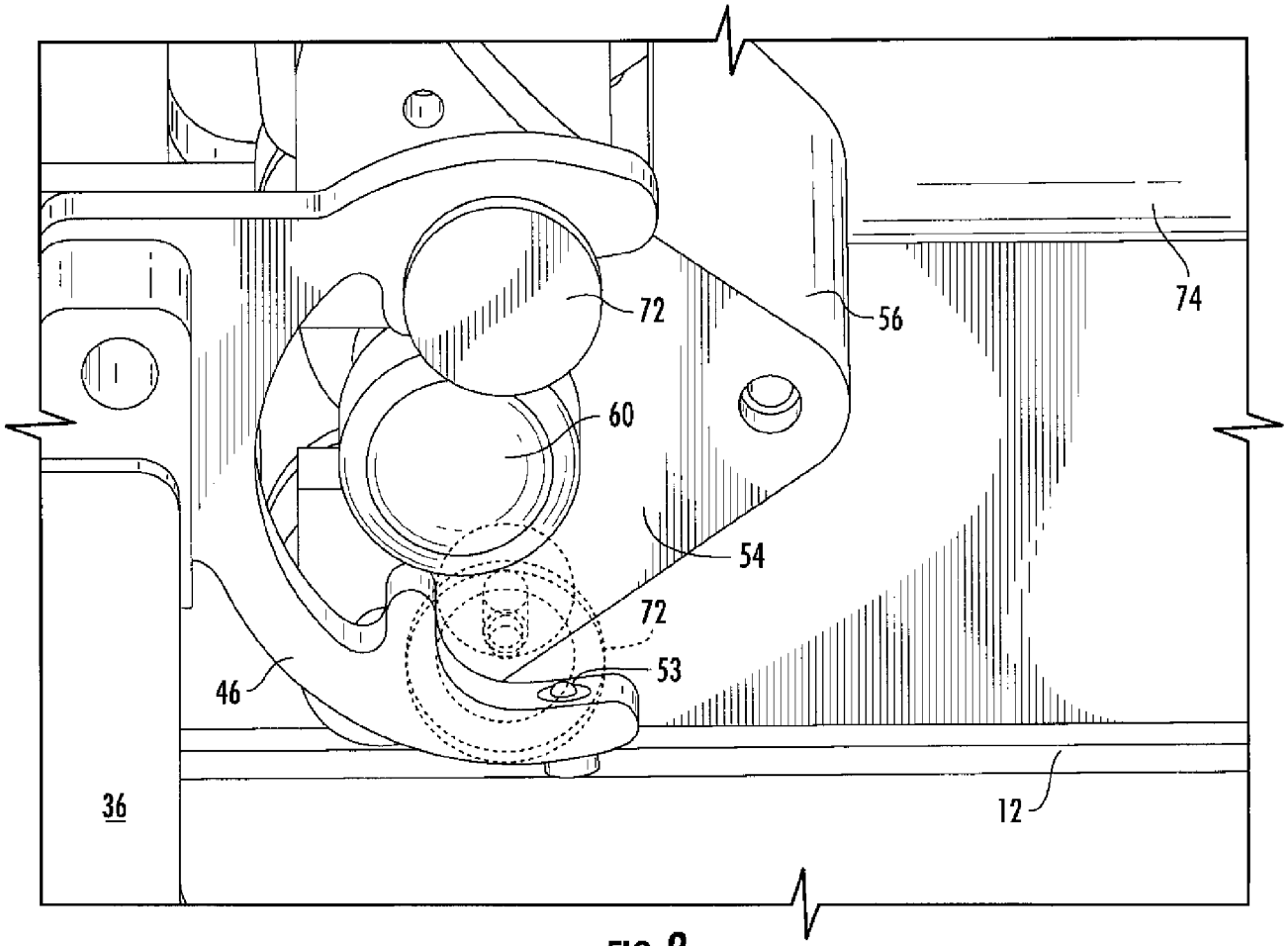

The operation of the proofer apparatus 10 may thus be understood. Initially, with the proofer assembly 20 demounted from the carriage 18, a test length of printing is placed onto the printing surface 14 of the table 12 and secured under the clamp 32. The carriage 18 is moved to a starting position at the end of the table 12 most closely adjacent the paper clamp 32 and, as depicted in the sequential views of FIGS. 5-8, the proofer assembly 20 is then mounted to the carriage 18 by manually manipulating the proofer assembly 20, preferably via the handle 74, to initially insert the upper capstans 72 of the proofer assembly 20 into the respective receiving areas 46A of the C-shaped bracket elements 46 and then into seated abutment within the upper abutment surfaces 46B thereof. Such step is most readily accomplished with the proofer assembly tilted downwardly via the handle 74, as depicted in FIG. 6. While maintaining the upper capstans 72 engaged in the upper abutment surfaces 46B, the proofer assembly 20 is then rotated downwardly to move the lower capstans 72 into receiving areas 46A of the C-shaped bracket elements 46. As shown in FIG. 7, the detent elements 53 are deflected by the lower capstans 72 until the capstans 72 seat against the lower abutment surfaces 46D, whereupon the detent elements 53 resume their normal spring-loaded disposition in which the detents 53 act to retain the proofer assembly 20 engaged with the bracket assembly 44, as depicted in FIG. 8.

With the proofer assembly 20 thusly mounted in its operative disposition, an appropriate quantity of the printing composition to be proofed, e.g., an ink or other coating material, is applied in the nip area between the anilox roller 22 and the doctor blade 26, and the carriage 18 and the proofer assembly 20 are moved as a unit along the length of the printing surface 14 of the table 12 by manual exertion of a pulling force on the proofer handle 74, causing rotation of the anilox roller 22 and the transfer roller 24 to apply the printing composition along the length of the paper. Of course, as will be recognized, the proofer assembly 20 may also be used independently of the table 12, if it is desired to perform proofing operations apart from the carriage 18.

The advantages of the proofer apparatus 10 over known manual proofers will thus be understood. The matability of the bracket assembly 44 of the carriage 18 and the capstan elements 72 of the proofer assembly provide a quick-connect form of selective attachment and detachment of the proofer assembly to and from the carriage without requiring fasteners or tools, and serves to secure the proofer assembly 20 in an optimal disposition and relationship to the printing surface 14 of the table 12 with reliable repeatability each time the proofer assembly is mounted to the carriage. The apparatus further maintains a consistent pressure of the proofer assembly against the printing surface, thereby eliminating the need for the operator to manually modulate the pressure exerted by the proofer assembly and, in turn, assuring consistent proofing results from one operator to another. The apparatus is easily portable, and is totally manual in operation, not requiring electricity or any other utility service. The slotted form of attachment of the anilox roller 22 also permits simple and quick exchange of one anilox roller for another, enabling multiple printing proofs to be performed with different anilox rollers in a minimal amount of time. The magnetic securement of the doctor blade also insures a consistently repeatable force of contact with the anilox roller to further promote reliable and consistent proofing results.

Figure 9:
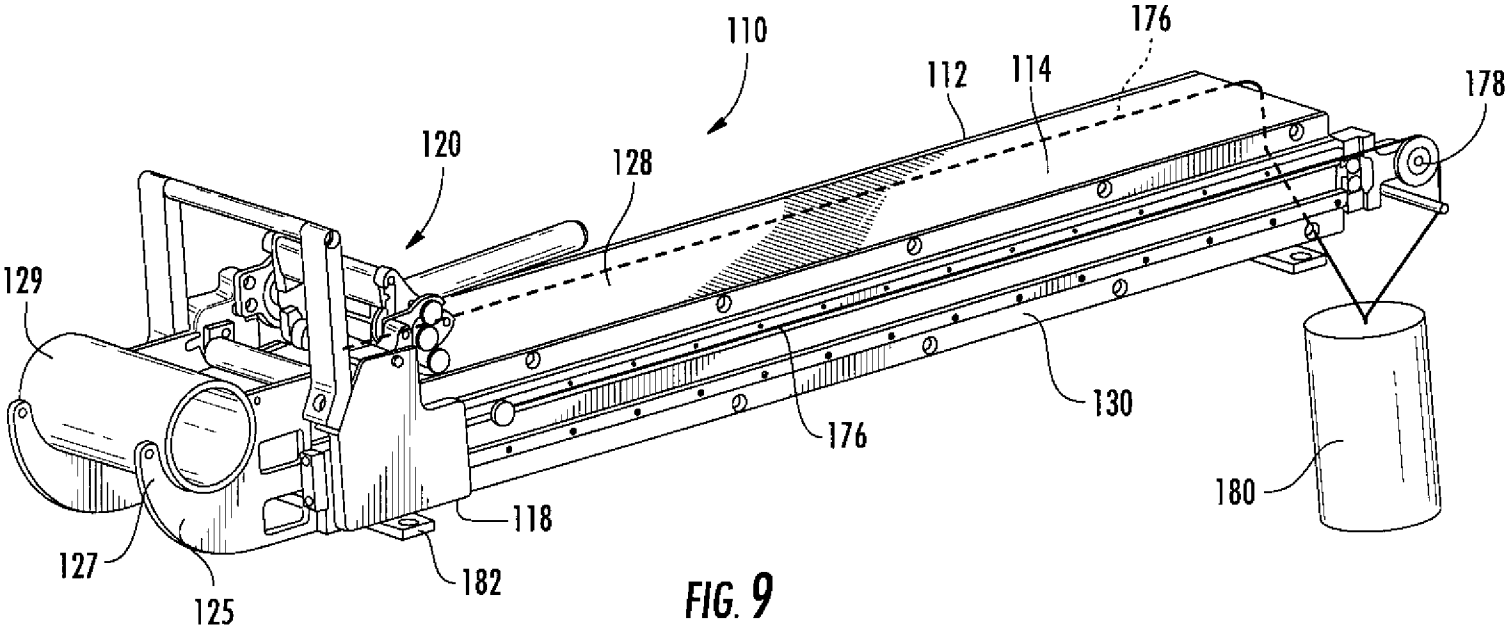
FIG. 9 is a perspective view of another embodiment of the proofer apparatus of the present invention.

As persons skilled in the relevant art will recognize and understand, the proofer apparatus is susceptible of various alternative embodiments which are within the scope of the present invention. By way of example, FIG. 9 depicts another proofer apparatus according to the present invention which includes several features that may be additionally advantageous in differing embodiments of the proofer apparatus. The proofer apparatus of FIG. 9 is indicated overall at 110 and basically includes a table 112, a carriage 118 movable along the table 112, and a proofer assembly 120 mountable and demountable to and from the carriage 118.

The carriage 118 and the proofer assembly 120 are of substantially the same construction and operation as the carriage 18 and proofer assembly 20 of FIGS. 1-8, and therefore need no further description. The table 112, as an alternative to printing onto discrete individual sheets of printing paper, includes an extension portion 125 projecting rearwardly from each of the table side members 130 to form a bracket 127 for supporting a roll of printing paper 129 in a disposition to unwind any desired length of paper from the roll 129 onto the printing surface 114 of the table 112.

The proofer apparatus 110 of FIG. 9 also includes a means of actuating printing travel of the carriage 118 and the proofer assembly 120 as a unit in a controlled but non-manual manner. Specifically, drive cables 176 are attached respectively to the lateral frame members 136 of the carriage 118 and extend therefrom over idler pulleys 178 affixed to the outward sides of the side members 130 at the front end of the table 112. Each drive cable 176 extends downwardly from the respective idler pulley 178 and is affixed to a weight 180 having sufficient mass to drive travel of the carriage 118 and the proofer assembly 120 as a unit under the force of gravity acting on the weight. The proofer apparatus 110 may thus be mounted to a bench, desk or other elevated work surface (not shown), e.g., via mounting tabs 182, with the weight 180 suspended gravitationally over one end of the work surface. A latch (not shown) may be provided adjacent the bracket 127 to hold the carriage and proofer assembly unit in a starting position preparatory to a proof printing operation. Upon release of the latch, the force of gravity acting on the weight 180 causes the unit to travel along the table 112 to execute a printing proof without the necessity of manually engaging the unit. By the selection of the appropriate mass of the weight, the carriage and proofer assembly unit may thus be driven non-manually in a repeatably controlled manner.

Another contemplated embodiment of the proofer apparatus, not shown in any of the drawings, is that the proofer assembly may be constructed with only an engraved anilox roller, without a transfer roller, and with the anilox roller disposed immediately adjacent the printing surface for direct contact with the printing substrate thereon. In this manner, the apparatus is adapted to perform printing proofs in a manner simulating a gravure printing process. To facilitate such a proofing operation, a flexible cover would be placed on the printing surface of the table deck as a cushion beneath the substrate to be printed. Such a proofer apparatus would transfer an increased amount of ink to the substrate, roughly double, as compared to a proofing apparatus like that of FIG. 1-8 or 9. Such a printing operation is suitable for the printing of fine images, such as a printed circuit pattern.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A portable proofing apparatus adapted for manual portability from one location to another for producing sample test printings of inks and coatings, the proofing apparatus comprising:

a table defining an elongated printing surface for supporting a printable substrate in stationary disposition along the printing surface for receiving a test printing, a carriage supported on the table for reciprocal movement of the carriage in a defined path longitudinally along the printing surface and along the printable substrate thereon, and a proofer assembly comprising an anilox roller supported for rotation about a longitudinal roller axis for applying a printing material, the carriage and the proofer assembly having respectively matable quick-connect elements for selective attachment and detachment of the proofer assembly to and from the carriage into and out of an operative printing disposition without fasteners or tools, the quick-connect element of the proofer assembly comprising a pair of spaced-apart bearing elements at each of opposite ends of the proofer assembly, the bearing elements of each pair being disposed at opposite sides of the axis of the anilox roller, and the quick-connect element of the carriage comprising a pair of spaced apart C-shaped bracket elements, each bracket element defining an open receiving area facing the printing surface of the table with opposed facing spaced-apart bearing abutment surfaces configured for mated receipt of the bearing elements of the proofer assembly, at least one of the bracket elements of the carriage comprising a resiliently-biased detent element facing inwardly within the receiving area for engagement with one of the bearing elements for deflection thereby upon passage of the bearing elements into and out of the receiving area and for retaining the bearing elements in an operational disposition supporting the anilox roller adjacent the printing surface when the bearing elements are mated within the receiving area.

2. A portable proofing apparatus according to claim 1, wherein the spaced-apart bearing abutment surfaces of the bracket element of the carriage comprises a first abutment surface within the receiving area for engagement with a first bearing element of the proofer assembly and a second abutment surface within the receiving area for engagement with a second bearing element of the proofer assembly.

3. A portable proofing apparatus according to claim 1, wherein the proofer assembly further comprises a transfer roller in axially-parallel peripheral surface abutment with the anilox roller and a doctor blade supported in tangential relation to the anilox roller.

4. A portable proofing apparatus according to claim 3, wherein the transfer roller is supported in surface contact with a printable substrate on the printing surface when the proofer assembly is attached to the carriage in the operative printing disposition.

5. A portable proofing apparatus according to claim 3, wherein the proofer assembly comprises a positioning element for the doctor blade, and the doctor blade and the positioning element comprise respectively attractive magnetic elements for urging the doctor blade into an operational position relative to the anilox roller.

6. A portable proofing apparatus according to claim 3, wherein the proofer assembly comprises a frame element defining a receiving slot for selective attachment and detachment of the anilox roller to and from the frame element without fasteners or tools.

7. A portable proofing apparatus according to claim 6, wherein the receiving slot is oriented relative to the transfer roller for deflection thereof upon insertion and removal of the anilox roller into and out of the slot and for retaining the anilox roller against unintended removal from the slot when fully received within the slot.

8. A portable proofing apparatus according to claim 3, wherein the proofer assembly includes a handle for manual actuation of movement of the carriage and the proofer assembly as a unit when the proofer assembly is mated to the carriage.

9. A portable proofing apparatus according to claim 3, wherein the carriage further comprises a weighted element attached to the carriage via a pulley arrangement for actuation of movement of the carriage and the proofer assembly as a unit when the proofer assembly is mated to the carriage via gravitational action on the weighted element.

10. A portable proofing apparatus according to claim 1, wherein the table comprises a support for a roll of substrate material in disposition to feed the substrate onto the printing surface.

11. A portable proofing apparatus according to claim 10, wherein the table further comprises a clamping roller movable between an operative clamping position at the printing surface for holding the substrate thereagainst and an inoperative parked position spaced above the printing surface for permitting feeding of the substrate from the roll of substrate material.

12. A portable proofing apparatus adapted for manual portability from one location to another for producing sample test printings of inks and coatings, the proofing apparatus comprising:

a table defining an elongated printing surface for supporting a printable substrate in stationary disposition along the printing surface for receiving a test printing, a carriage supported on the table for reciprocal movement of the carriage in a defined path longitudinally along the printing surface and along the printable substrate thereon, and a proofer assembly removably mounted to the carriage and comprising a pair of frame elements rotatably supporting a transfer roller and each defining a receiving slot for rotatably supporting an anilox roller adjacent the transfer roller, each receiving slot having an open entrance end for selective insertion and removal of the anilox roller into and from the respective frame element through the open entrance end of the receiving slot into and out of a printing disposition relative to the transfer roller without fasteners or tools, each receiving slot being oriented relative to the transfer roller for peripheral contact between the anilox roller and the transfer roller causing deflection of the transfer roller away from the receiving slot during insertion and removal of the anilox roller into and out of the receiving slot and for retaining the anilox roller against unintended removal from the receiving slot when fully received within the receiving slot.

13. A portable proofing apparatus according to claim 12, wherein the anilox roller comprises a pair of bushings disposed at opposite axial ends of the anilox roller and received in the respective receiving slots.

14. A portable proofing apparatus according to claim 13, wherein the bushings are detachable from the anilox roller for use with differing anilox rollers, thereby to facilitate interchanging of the anilox roller with another anilox roller.

15. A portable proofing apparatus adapted for manual portability from one location to another for producing sample test printings of inks and coatings, the proofing apparatus comprising:

a table defining an elongated printing surface for supporting a printable substrate in stationary disposition along the printing surface for receiving a test printing, a carriage supported on the table for reciprocal movement of the carriage in a defined path longitudinally along the printing surface and along the printable substrate thereon, and a proofer assembly removably mounted to the carriage and comprising a frame with opposing spaced-apart frame elements, an anilox roller rotatably supported between the frame elements for applying a printing material, a doctor blade affixed to a support bar, a mounting seat on each frame element for receiving opposite ends of the support bar, and a positioning element on each frame element for abutment with the support bar for locating the doctor blade in tangential relation to the anilox roller for metering the printing material, each end of the support bar for the doctor blade and the positioning element on each frame element comprising respectively attractive magnetic elements for urging the doctor blade into, and retaining the doctor blade in, an operational position relative to the anilox roller.

16. A portable proofing assembly adapted for manual portability from one location to another comprising:

a pair of single-piece frame elements, each single-piece frame element rotatably supporting a transfer roller and defining a receiving slot for rotatably supporting an anilox roller adjacent the transfer roller, each receiving slot having an open entrance end for selective insertion and removal of the anilox roller into and from the respective single-piece frame element through the open entrance end of the receiving slot into and out of a printing disposition relative to the transfer roller without fasteners or tools, each receiving slot being oriented relative to the transfer roller for peripheral contact between the anilox roller and the transfer roller causing deflection of the transfer roller away from the receiving slot during insertion and removal of the anilox roller into and out of the receiving slot and for retaining the anilox roller against unintended removal from the receiving slot when fully received within the receiving slot.

17. A portable proofer assembly according to claim 16, wherein the anilox roller comprises a pair of bushings disposed at opposite axial ends of the anilox roller and received in the respective receiving slots.

18. A portable proofer assembly according to claim 17, wherein the bushings are detachable from the anilox roller for use with differing anilox rollers, thereby to facilitate interchanging of the anilox roller with another anilox roller.

19. A portable proofing assembly adapted for manual portability from one location to another comprising:

a frame with opposing spaced-apart frame elements, an anilox roller rotatably supported between the frame elements for applying a printing material, a doctor blade affixed to a support bar, a mounting seat on each frame element for receiving opposite ends of the support bar, and a positioning element on each frame element for abutment with the support bar for locating the doctor blade in tangential relation to the anilox roller for metering the printing material, each end of the support bar for the doctor blade and the positioning element on each frame element comprising respectively attractive magnetic elements for urging the doctor blade into, and retaining the doctor blade in, an operational position relative to the anilox roller.

* * * * *